US008046883B2

(12) United States Patent
Scruggs

(10) Patent No.: US 8,046,883 B2
(45) Date of Patent: Nov. 1, 2011

(54) EDGED NON-HORIZONTAL BURIAL CONTAINERS

(76) Inventor: Donald E. Scruggs, Chino, CA (US)

( * ) Notice: Subject to any disclaimer, the term of this patent is extended or adjusted under 35 U.S.C. 154(b) by 0 days.

(21) Appl. No.: 12/587,550

(22) Filed: Oct. 8, 2009

(65) Prior Publication Data

US 2010/0031482 A1 Feb. 11, 2010

Related U.S. Application Data

(62) Division of application No. 11/477,236, filed on Jun. 28, 2006, now Pat. No. 7,631,404.

(51) Int. Cl.
*A61G 17/00* (2006.01)

(52) U.S. Cl. ..... 27/35; 52/128

(58) Field of Classification Search ..... 27/35, 2, 27/1; 52/128, 133, 136
See application file for complete search history.

(56) References Cited

U.S. PATENT DOCUMENTS

| | | | | | |
|---|---|---|---|---|---|
| 3,188,712 | A * | 6/1965 | Bauermeister | 27/6 |
| 3,581,452 | A * | 6/1971 | Jalbert | 52/133 |
| 3,681,820 | A * | 8/1972 | Jalbert | 27/7 |
| 3,898,718 | A * | 8/1975 | Eubank | 27/35 |
| 3,918,133 | A * | 11/1975 | Schmitz | 27/2 |
| 3,940,894 | A * | 3/1976 | Nunes | 52/129 |
| 4,328,606 | A * | 5/1982 | Nunes | 27/35 |
| 4,893,385 | A * | 1/1990 | Schrag | 27/35 |
| 5,127,112 | A * | 7/1992 | Brock | 27/1 |
| 7,127,783 | B1 * | 10/2006 | Poole et al. | 27/1 |
| 2002/0144383 | A1 * | 10/2002 | Spence | 27/35 |

* cited by examiner

*Primary Examiner* — William L. Miller

(57) ABSTRACT

Burial containers to be power installed in non-horizontal positions without the need to dig large holes and subsequently replace the dug out material, and which greatly save land area, plus can be interred in high water table areas and even under shallow water.

6 Claims, 4 Drawing Sheets

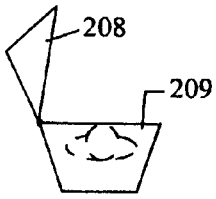
Fig. 28
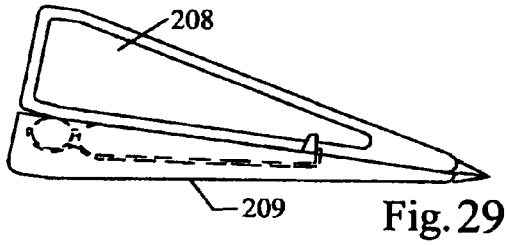
Fig. 29
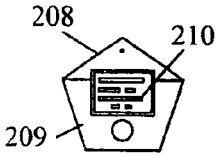
Fig. 30
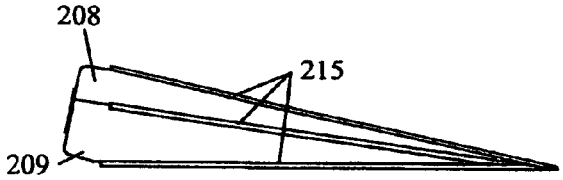
Fig. 31
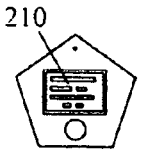
Fig. 32
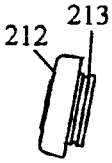
Fig. 33
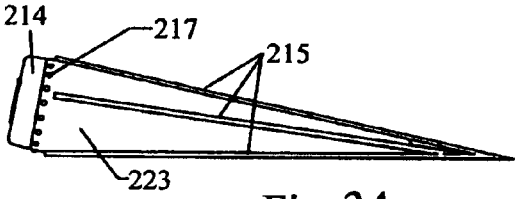
Fig. 34
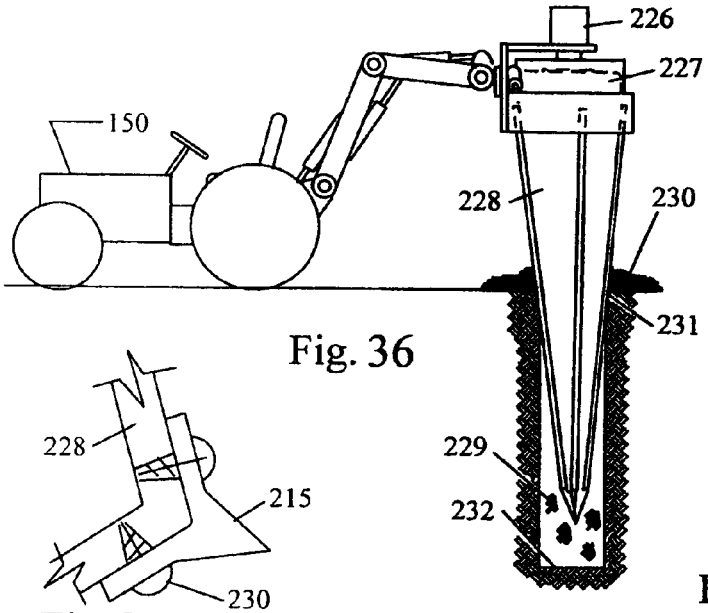
Fig. 36
Fig. 35
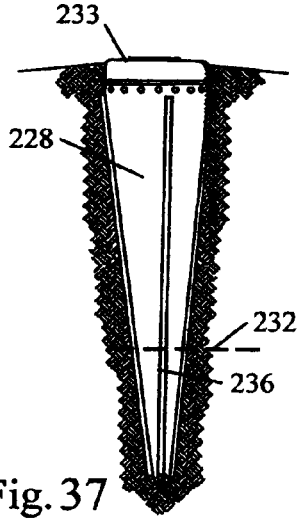
Fig. 37

EDGED NON-HORIZONTAL BURIAL CONTAINERS

CROSS-REFERENCE TO RELATED APPLICATIONS

Division of Easy Inter Burial Container, Ser. No. 11/477,236 of Jun. 28, 2006 now U.S. Pat. No. 7,631,404.

FEDERALLY SPONSORED RESEARCH

Not Applicable

SEQUENCE LISTING OR PROGRAM

Not Applicable

FIELD OF THE INVENTION

This invention relates to conserving land area by using easy to install burial containers which can be self bored into earth or other receiving materials and do not require a large amount of land area or a large pre-dug rectangular hole.

BACKGROUND OF THE INVENTION

A common current interment practice is to first move a body to a mortuary where it is prepared for funeral services. In cases where a body is unclaimed, it is usually provided with minimum preparation and burial, paid for by public funds. A claimed body, after mortuary preparation, is usually placed in an ascetically pleasing casket and either displayed in an open casket funeral service or the casket alone is visible in a closed casket service. Often, after an indoor service the body and casket are moved to a prepared grave site in a cemetery, where a final service is performed.

At the prepared grave site the casket containing the body is set either on or in a box like crypt during a grave side funeral service, if one is conducted. None of these burial services need be changed for the use of a Edged Non-Horizontal Burial Container. Several types of these burial containers are designed to be set on a floral or otherwise decorated boxes for open or closed casket funeral services in an in door or out door environment.

Currently the prepared grave is often a rectangular excavation approximately four feet wide by seven and a half feet long by six and a half feet deep. Walkways are left on all sides of the grave for later visitors, making a total of over 50 square feet of ground area to be set aside for each grave. The Edged Non-Horizontal Burial Container method requires only about one third of the land area used for current burials.

The removed earth or other receiving material from the current-type grave excavation is usually piled next to the grave site and covered during a grave side funeral service, if one is conducted. After funeral services, the casket and or box like crypt is lowered to the bottom of the prepared grave excavation and the removed receiving material is shoveled back into the excavation. In a Edged Non-Horizontal Burial Container interment there is not a large volume of earth or receiving material to dig out and later replace, as from a current type grave excavation.

In current type burials, the removed receiving material is replaced and continuously tamped to slightly above the ground level of the excavation to reduce later settling and the showing of a depression. The extra material, left over because of the displacement of the coffin and or box like crypt, is hauled away. Ground cover, such as grass, is then restored over the site. In a Edged Non-Horizontal Burial Container burial, the receiving material from a far smaller hole is all that is left over and can be easily removed or scattered lightly over the surrounding area.

In current type burials, additional digging and preparation is often undertaken to provide for the installation of a headstone, plaque marker or monument and the installation of flower and flag receptacles for persons to later pay respects and honor the deceased. Provisions for plaques, markers, monuments, flower receptacles and flag receptacles are regularly built into Edged Non-Horizontal Burial Containers. With an eye to future grave site maintenance, a number of tops and end pieces, which will show at the grave site, are made very low to insure power mower clearance and some even have small channels around their outside edges for weed killer to mitigate the normal encroachment of the cemetery's ground cover.

Cemetery properties are usually selected and developed in costly, but pleasant areas with level and softer earth or other receiving materials. Roads, landscaping, fences, monuments, statues, trees, ponds and other items are added for utility and aesthetics. The cost of each grave site, and thus each burial, is relative to the number of grave sites on the developed cemetery property. The future business of a cemetery is based not only on maintenance of filled graves, but on the number of empty grave sites remaining within the cemetery. With the Edged Non-Horizontal Burial Container method a cemetery has about three times the grave sites as in current practice. In addition, these containers can be readily installed in ponds, steeply sloped land and very near to trees, adding greatly to the available grave site total in a cemetery.

The labor currently required to prepare a grave, perform a burial and return a site to a finished condition adds significantly to the high cost of each burial. The Edged Non-Horizontal Burial Container method eliminates the need for a large rectangular excavation, the extensive subsequent refilling, and the later excavation for installation of grave markers and plaques.

It should be noted here that many cemeteries are discouraging the erection of monuments which rise above ground cover level, because of the difficulty of mowing around them with the presently used large power mowers. These cemeteries usually charge more for a grave site with a monument, with the additional amount going into the ongoing maintenance fund.

All in all, the Edged Non-Horizontal Burial Container method significantly reduces the cost of each grave site and each burial and approximately triples the business potential for each existing and new cemetery.

OBJECTS OF THE INVENTION

It is a main object of this invention to greatly reduce the cost of each grave site by significantly reducing the land area required for each burial.

It is another object of this invention to reduce the cost of a burial by significantly reducing the amount of excavation and replacement of the receiving material and ground cover replanting for each burial.

It is an object of this invention to greatly reduce the secondary labor currently required to finish a grave site after interment by providing for plaque, monument, flag and flower placement as an integral part of the burial container.

An additional object of the invention is to provide for the use of less expensive land for grave sites by providing a means to inter bodies in horizontal, sloping or near vertical land surfaces not currently used.

OPERATING PRINCIPALS AND PREFERRED EMBODIMENT

Although the preferred embodiment of this invention is to use a Edged Non-Horizontal Burial Container with a strong hull, tapered toward the base end, with a wrench drivable opposite end, and power equipment to make the installation. There are numerous variations in design and installation methods shown herein which are required to meet the needs of different environments and social conditions and are entirely within the scope of this invention.

In a primary embodiment of this invention, following mortuary preparations, the body is placed inside a lavish display casket for a funeral service. After the funeral service the body and tray are enclosed within a sturdy shroud, which is securely attached to a body shaped tray. The tray, body and shroud are then placed into a Edged Non-Horizontal Burial Container.

A drilling auger, such as those commonly used on a power-take-off attached on the working arm of a tractor-backhoe type vehicle, can be used to bore a pilot hole in the direction of the intended Edged Non-Horizontal Burial Container installation. The depth of this hole is usually about one-third the length of the Edged Non-Horizontal Burial Container and less than half its diameter, depending upon the type and condition of the earth or receiving material in which the burial is to be made. Adding an amount of water to the hole aids in causing the earth or receiving material to displace and more readily pack back around the Edged Non-Horizontal Burial Container as well as helps lubricate the passage of the hull during installation.

A vehicle then manipulates a gripping, rotating and revolving device over and around the Edged Non-Horizontal Burial Container. Once the gripping device or socket wrench tool is properly fitted onto the upper portion of a Edged Non-Horizontal Burial Container hull, the burial unit is set in place and revolved for interment.

A variation is a Edged Non-Horizontal Burial Container made to look like a currently used coffin or casket for display of the body during funeral services. After funeral services, the contents are securely retained within the container and a sturdy tapered exterior foot piece, with blades, is attached and the entire unit and its contents are lifted by the headpiece and hull and is manipulated to effect satisfactory interment into the receiving material. This design bores its own final hole.

Another self boring type of Edged Non-Horizontal Burial Container is split lengthwise like a current casket so it can be used in conventional funeral services. It has blades extending outward from the tapered hull to approximately the diameter of the largest end of the Edged Non-Horizontal Burial Container and has cutting edges on the lower end of these blades.

DESCRIPTION OF FIGURES

FIG. 28 is a end view of a pentagonal cross section shaped Edged Non-Horizontal Burial Container, made to look somewhat like a conventional casket, except tapered for later easy installation into receiving materials, showing its upper or lid section, 208, and its lower or main section, 209, in open position, as in an open casket funeral service.

FIG. 29 is a side view of the unit shown in FIG. 28, with its upper section, 208, in an open position above its lower or main section, 209, illustrating its tapered shape.

FIG. 30 is an end view of the same unit shown in FIG. 28, with its upper section, 208, closed over its lower section 209, and having a marker plaque, 210, in place to act as additional closure security and to mark the grave site after installation.

FIG. 31 is a side view of the closed Edged Non-Horizontal Burial Container in FIG. 29, showing its upper section, 208, and its lower section, 209, and noting its cutting blades, 215, at the junctures of its sides. See FIG. 35.

FIG. 32 is an end view of a pentagonal cross section Edged Non-Horizontal Burial Container made with a non-split, single piece hull and having a top cap and a plaque, 210.

FIG. 33 is a side view of a pentagonal shaped top cap, 212, made to fit into and become a part of the unit shown in FIG. 34, highlighting the groove, 213, into which attachment hardware will fit through the hull and secure the top.

FIG. 34 is a side view of a single piece hull, 223, with top cap, 214, Edged Non-Horizontal Burial Container, showing its top cap attachment hardware, 217, and cutting blades, 215.

FIG. 35 is a cross section of the junction of sides of a Edged Non-Horizontal Burial Container hull, 228, with extra cutting blades, 215, attached with metal fasteners, 230.

FIG. 36 is a side view of a tractor backhoe, 150, using a drive motor, 226, and a five sided wrench, 227, to install a pentagonal cross section Edged Non-Horizontal Burial Container as shown in FIGS. 28, 30 and 32, with its main hull, 228, inserted into a augered hole, 231, and showing the bottom of the original hole, 232, through which the lower, tapered end of the main hull will penetrate as it is revolved and bores into the hole, 231, with cut-off receiving material, 229, dropping into the hole.

FIG. 37 is a cut away view of the main hull, 228, in FIG. 36 after it has been fully installed with its lower, tapered end, 236, penetrating the receiving material below the bottom line, 232, of the original hole and indicating its visible top portion, 233.

Figure 1:
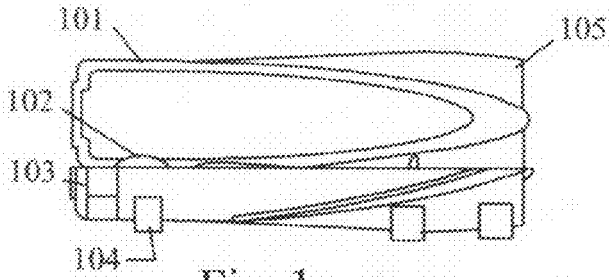
FIG. 1 is a side view of a Edged Non-Horizontal Burial Container with self digging curved blades, 105, and a hull split lengthwise into a open, padded, upper lid segment, 101, and a lower main section, 103, as is common practice in current coffins and caskets, with a body and body tray, 102, inside, and being stabilized and held level by blocks, 104, for funeral display.
Figure 2:
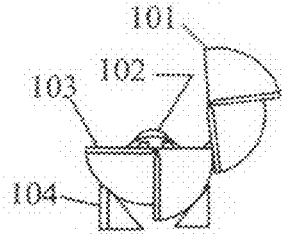
FIG. 2 is an end view of the Edged Non-Horizontal Burial Container shown in FIG. 1, illustrating the positions of the raised lid segment, 101, body and body tray, 102, lower main section, 103, and the support blocks, 104.
Figure 3:
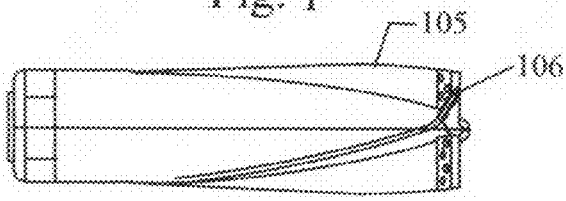
FIG. 3 is a side view of the Edged Non-Horizontal Burial Container in FIG. 1, except in its closed position showing curved blades, 105, which guide the cut away receiving material to the surface, and added on cutting blades, 106.
Figure 4:
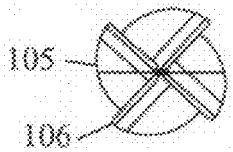
FIG. 4 is and end view of the Edged Non-Horizontal Burial Container in FIG. 3 showing the relationship of the cutting blade extensions, 105, and the added on cutting blades, 106.
Figure 5:
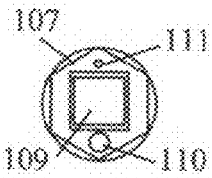
FIG. 5 is an end view of the screw in top in FIG. 6 and the matching single piece hull in FIG. 7, showing the driven flats, 107, rectangular plaque or monument area, 109, flower receptacle, 110 and flag holder, 111.
Figure 6:
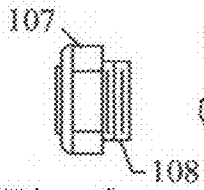
FIG. 6 is a side view of the screw in top, which fits the hull depicted in FIG. 7, pointing out its driven flats, 107, and the threads, 108, to match those inside the hull.
Figure 7:
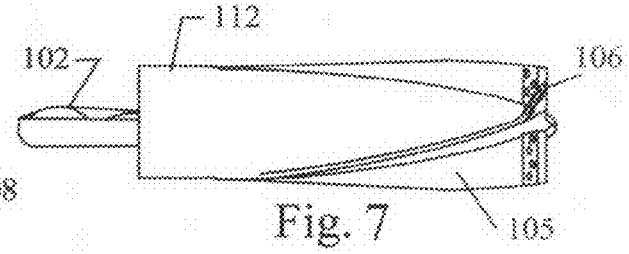
FIG. 7 is a side view of a single piece, non-split hull, 112, with a body and body tray, 102. Note that the hull has cutting blade extensions, 105, and added on cutting blades, 106, for self digging and movement of loosened receiving material to the surface.
Figure 8:
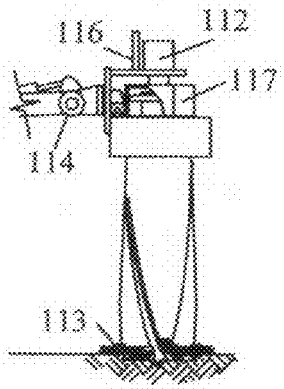
FIG. 8 is a side view of a Edged Non-Horizontal Burial Container with curved blades and cutting blade extensions being held by a device, 116, on the end of a vehicle arm, 114, and revolved by a socket wrench, 117, driven in the correct direction by a drive motor, 112. Note the removed receiving material, 113, around the start of the hole.
Figure 9:
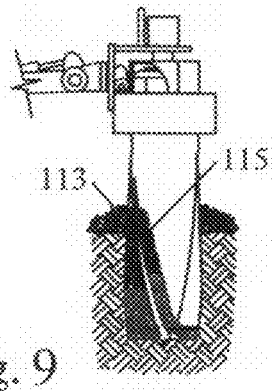
FIG. 9 is a cut away side view of the self digging Edged Non-Horizontal Burial Container in FIG. 8, having dug into the receiving material with some dug away receiving material, 113, outside of the hole and additional dug away material, 115, being forced upward and out by the curved blades.
Figure 10:
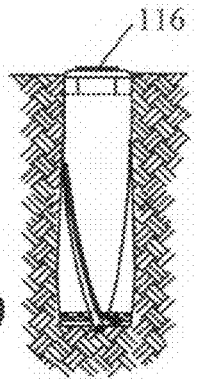
FIG. 10 is a cut away side view of the self digging unit in FIGS. 8 and 9, now fully installed, showing its top, 116, and its final positioning after the receiving material around the hull has been tamped and the surplus removed.
Figure 11:
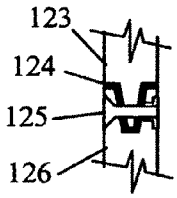
FIG. 11 is a cross sectional view of the joint of a typical upper, 123, and lower section, 126, of a Edged Non-Horizontal Burial Container pointing out the gasket seal, 124, and one of the through joint counter sunk screw and nut assemblies, 125.
Figure 12:
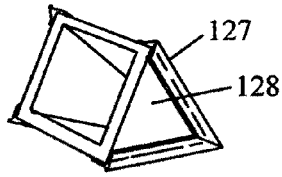
FIG. 12 shows a pyramidal nose piece, 128, to be placed on a square cross section casket like that shown in FIG. 13, to provide additional closure of the casket and a digging point for the unit. Also shown are the cutting edges, 127.
Figure 13:
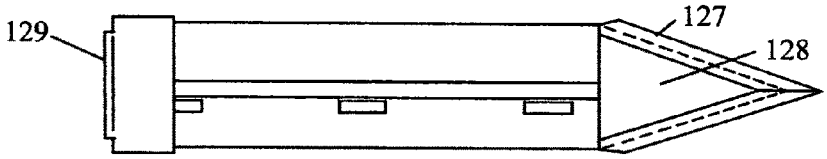
FIG. 13 is a side view of a casket with a pyramidal nose piece, 128, and cutting edges, 127, at the foot end and a shaped end cap, 129, added to the head end, which provides a driven section for the clamping gripper driver device shown as 130 in FIG. 15.
Figure 14:
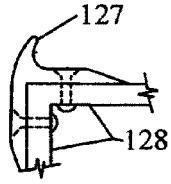
FIG. 14 is a cross section cut-away of a typical optional cutting edge, 127, attached to a corner formed by the juncture of two sides of a pyramid shaped nose piece, 128.
Figure 15:
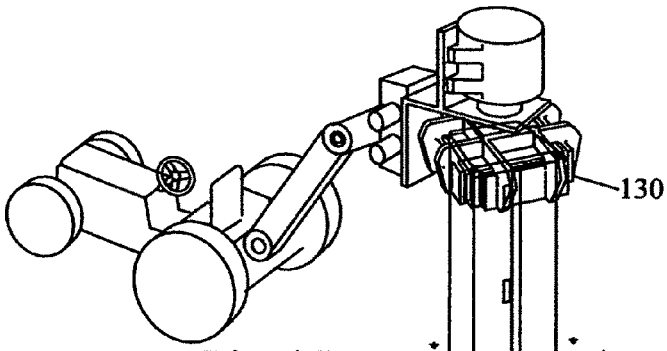
FIG. 15, is a tractor backhoe using a square section clamping gripper driver, 130, to hold, revolve and press a casket, as that shown in FIG. 13, into a pre-bored or augered hole, 131.
Figure 16:
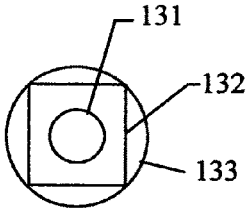
FIG. 16 illustrates the relationship of the original pre-bored or augered hole, 131, the square cross section of the container, 132, as shown in FIG. 13, and the circular sidewall of the hole, 133, caused by the action of the corners of the cutting blades, 137, in FIGS. 13 and 14, as the unit is rotated in the correct direction.
Figure 17:
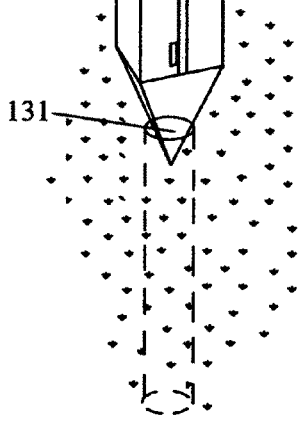
FIG. 17 is a view of the finished installation of the Edged Non-Horizontal Burial Container shown in FIG. 15, with only its end cap, 129, showing and with the nose piece having bored its way into the bottom of the pre-bored or augered hole and the displaced receiving material settled and tamped into the former spaces between the hole and the sidewalls of the Edged Non-Horizontal Burial Container.
Figure 17:
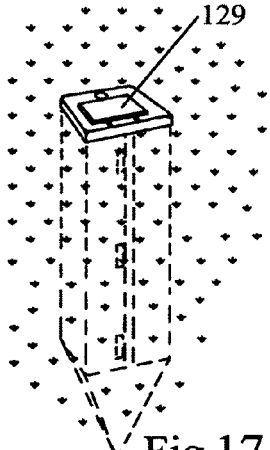
Figure 18:
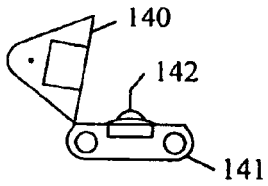
FIG. 18 is and end view of a triangular cross section Edged Non-Horizontal Burial Container, split lengthwise and hinged, with its lid or upper section, 140, in the open position and its lower or main hull section, 141, containing a body, 142.
Figure 19:
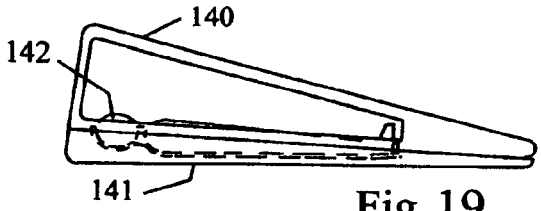
FIG. 19 is a side view of the Edged Non-Horizontal Burial Container in FIG. 18, also with its upper section, 140, open and its main or lower section, 141, containing a body, 142, which is resting in a form fitting body tray, 143, within the burial container and showing a taper from the head section to the foot section.
Figure 20:
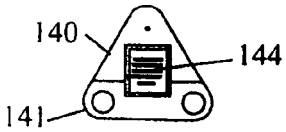
FIG. 20 is an end view of the unit shown in FIGS. 18 and 19, except with its upper section, 140, closed down against its main or lower section, 141, and showing the grave marker plaque, 144, covering the closure line and acting as additional closure security and which will show at ground level when the Edged Non-Horizontal Burial Container is interred.
Figure 21:
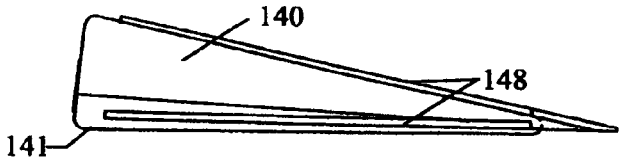
FIG. 21 is a side view of the closed Edged Non-Horizontal Burial Container in FIG. 20, with its upper section, 140, and its lower section, 141, indicated and with extra cutting blades, 148, along the junctures of its sides.
Figure 22:
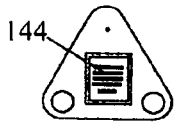
FIG. 22 is an end view of a Edged Non-Horizontal Burial Container, similar in its triangular cross section to the one depicted in FIG. 18, except being of a non-split, single piece hull design with a top cap (See FIG. 23). It also shows as having a marker plaque, 144.
Figure 23:
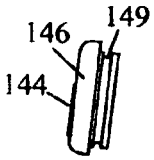
FIG. 23 is a side detail of a Edged Non-Horizontal Burial Container top cap, 146, with a marker plaque, 144, and a security groove, 149, in the area made to fit inside a triangularly shaped, single piece hull, as shown in FIG. 24.
Figure 24:
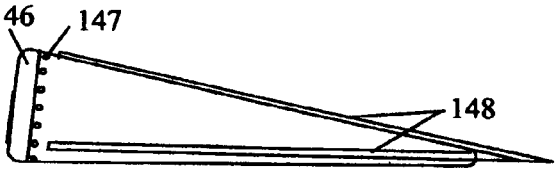
FIG. 24 is a side view of a non-split, single piece hull, with its top cap, 146, from FIG. 23, in place and a series of metal fasteners, 147, around the larger end of its hull, locking the top in place by their intrusion into the groove shown as 149 in FIG. 23. Also indicated are added on cutting blades, 148, similar to those detailed in FIG. 26.
Figure 25:
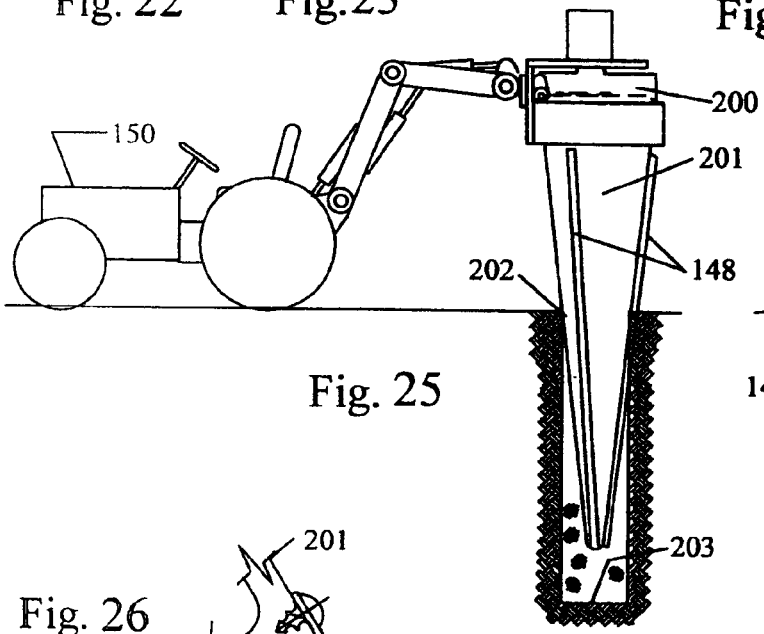
FIG. 25 is a side view of a tractor backhoe, 150, installing a triangular cross section Edged Non-Horizontal Burial Container, 201, similar to those shown in FIGS. 19, 21 and 24, by revolving it with a triangle shaped and powered wrench, 200, into a pre-dug pilot hole, 202, where its cutting blades, 148, are just beginning to remove receiving material, toward cutting its way and penetrating through the bottom of the pilot hole, 203.
Figure 26:
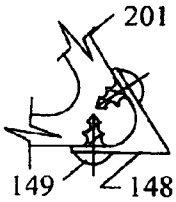
FIG. 26 is an enlarged cross section of a side junction of a triangular cross section Edged Non-Horizontal Burial Container hull, 201, showing metal fasteners, 149, and attachment of an added on cutting blade, 148.
Figure 27:
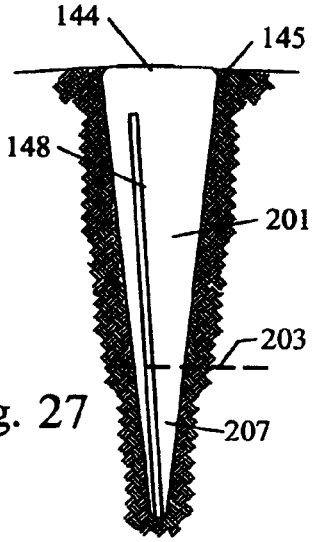
FIG. 27 is a cut away of the receiving material showing the final, interred position, of the Edged Non-Horizontal Burial Container, 201, from FIG. 25, after it has been revolved sufficiently to have its cutting blades, 148, widen the original pilot hole and bore through the bottom line, 203, of the original hole and settle a portion of the unit, 207, through the bottom of the hole, leaving only the marker plaque, 144, showing above the surrounding receiving material, 145.

I claim:

1. A burial container comprising:

a hull having a length, a first end, a second end, an outer surface, and an opening communicating with an interior of the hull;

the outer surface tapering inwardly along the length from a cross-section at the first end to a substantially reduced cross-section at the second end;

the outer surface including cutting elements comprising blade portions at the second end and blade extensions extending from the blade portions toward the first end along at least a portion of the length of the hull, the blade extensions reducing in size along the at least a portion of the length of the hull in a direction from the second end toward the first end such that the blade extensions merge into the hull;

a closure member secured to the hull to sealingly close the opening, the closure member including means for displaying items of memorialization thereon; and the closure member including means for engagement with an external device for rotation of the burial container and substantially vertical ground interment thereof.

2. The burial container of claim 1, wherein the closure member is a cap and the first end of the hull defines the opening.

3. The burial container of claim 1, wherein the hull is split along at least a portion of its length to define a lower section and an upper section connected thereto, the lower section defining the opening and the upper section defining the closure member.

4. A burial container comprising:

a hull having a polygonal cross-section, a length, a first end, a second end, an outer surface, and an opening communicating with an interior of the hull for receiving the deceased;

the outer surface tapering inwardly along the length from a cross-section at the first end to a substantially reduced cross-section at the second end;

the outer surface including at least one fin-shaped cutting element extending from the second end along substantially the entire length of the hull, each cutting element being positioned substantially at a respective juncture of adjacent sides of the hull;

a closure member secured to the hull to sealingly close the opening, the closure member including means for displaying items of memorialization thereon; and the closure member including means for engagement with an external device for rotation of the burial container and substantially vertical ground interment thereof.

5. The burial container of claim 4, wherein the closure member is a cap and the first end of the hull defines the opening.

6. The burial container of claim 4, wherein the hull is split along at least a portion of its length to define a lower section and an upper section connected thereto, the lower section defining the opening and the upper section defining the closure member.

* * * * *